United States Patent [19]

Tahata et al.

[11] Patent Number: 4,564,482

[45] Date of Patent: Jan. 14, 1986

[54] VARIABLE VENTURI TYPE CARBURETOR

[75] Inventors: Michio Tahata, Niiza; Masao Okamoto, Asaka; Hiroshi Enomoto, Ooi, all of Japan

[73] Assignee: Honda Giken Kogyo Kabushiki, Tokyo, Japan

[21] Appl. No.: 621,072

[22] Filed: Jun. 15, 1984

[30] Foreign Application Priority Data

Sep. 6, 1983 [JP] Japan ..... 58-163698

[51] Int. Cl.[4] ..... F02M 9/06

[52] U.S. Cl. ..... 261/44 B; 261/52

[58] Field of Search ..... 261/52, 44 B, 44 C

[56] References Cited

U.S. PATENT DOCUMENTS

| | | | |
|---|---|---|---|
| 1,375,898 | 4/1921 | Ciglia et al. | 261/44 B |
| 3,342,463 | 9/1967 | Date et al. | 261/44 C |
| 3,689,036 | 9/1972 | Kikuchi et al. | 261/52 |
| 3,753,555 | 8/1973 | Lawrence | 261/52 |
| 3,937,768 | 2/1976 | Bier et al. | 261/52 |
| 4,005,161 | 1/1977 | Shimo et al. | 261/52 |
| 4,159,290 | 6/1979 | Honma et al. | 261/52 |
| 4,302,405 | 11/1981 | Inoue et al. | 261/52 |

*Primary Examiner*—Tim Miles

[57] ABSTRACT

A variable venturi type carburetor comprising a carburetor body having an intake passage in which is disposed a slide valve slidably supported for travel across the intake passage to function as a variable venturi. A butterfly throttle valve is pivotably supported by the body in the intake passage downstream of the slide valve. A low-speed fuel passageway and a main fuel passageway open into the intake passage proximate the butterfly throttle valve and directly below the slide valve respectively. The slide valve and butterfly throttle valve are interconnected by a linkage for interlocked operation over a range from their fully closed positions to their fully opened positions with the degree of opening of the slide valve being greater than that of the butterfly valve by a predetermined magnitude at least for low opening degrees thereof. An external force is applied to one of the valves to operate that valve and the other of the valves conjointly therewith.

16 Claims, 2 Drawing Figures

VARIABLE VENTURI TYPE CARBURETOR

PRIOR ART

There has heretofore been known a variable venturi type carburetor wherein a slide throttle valve which is slidably displaceable across an intake passage is operated by a throttle wire. However, since the slide throttle valve is subjected to a force urging it toward a lower stream side of the valve in the direction of suction by the negative suction pressure of the engine, a comparatively great frictional force acts between the carburetor body and the side surface of the slide throttle valve facing the lower stream side, whereby the throttle wire must be operated with a comparatively great tractive force. In order to eliminate such drawback, there has been provided a variable venturi type carburetor of the so-called constant negative pressure system type wherein the negative suction pressure is controlled by a butterfly throttle valve disposed in the intake passage so as to drive the slide throttle valve in opening or closing direction by the controlled negative suction pressure. With such carburetor, in which the slide throttle valve is driven by the negative pressure, when the degree of opening of the butterfly throttle valve is suddenly increased for effecting a rapid acceleration from a low load condition, the negative suction pressure does not follow the sudden increase. Therefore, the operation of the slide throttle valve does not conform to the rapid acceleration and is deficient in acceleration response.

SUMMARY OF THE INVENTION

An object of the present invention is to provide a variable venturi type carburetor having excellent operability and acceleration response which overcomes the deficiencies of the conventional construction.

According to the present invention, in an intake passage formed in a carburetor body, there are disposed a slide valve which is slidable across the intake passage to function as a variable venturi, and a butterfly throttle valve which is pivotally supported downstream of the slide valve by the carburetor body. Further, a low-speed fuel passageway and a main fuel passageway are respectively open to the intake passage near the butterfly throttle valve and directly below the slide valve. The slide valve and the butterfly throttle valve are operatively connected to each other through an interlocking mechanism so as to perform their opening and closing operations in an interlocking manner over a range from the fully closed positions to fully open positions thereof; however, with the degree of opening of the slide valve being set higher than that of the butterfly throttle valve by a predetermined magnitude, at least, in the low opening degree regions thereof. A control member to which an external force is applied for operating the slide valve and the butterfly throttle valve is connected to either of these valves.

BRIEF DESCRIPTION OF THE FIGURES OF THE DRAWING

In the drawing is illustrated an embodiment of the present invention, in which.

DETAILED DESCRIPTION OF PREFERRED EMBODIMENT OF THE INVENTION

Figure 1:
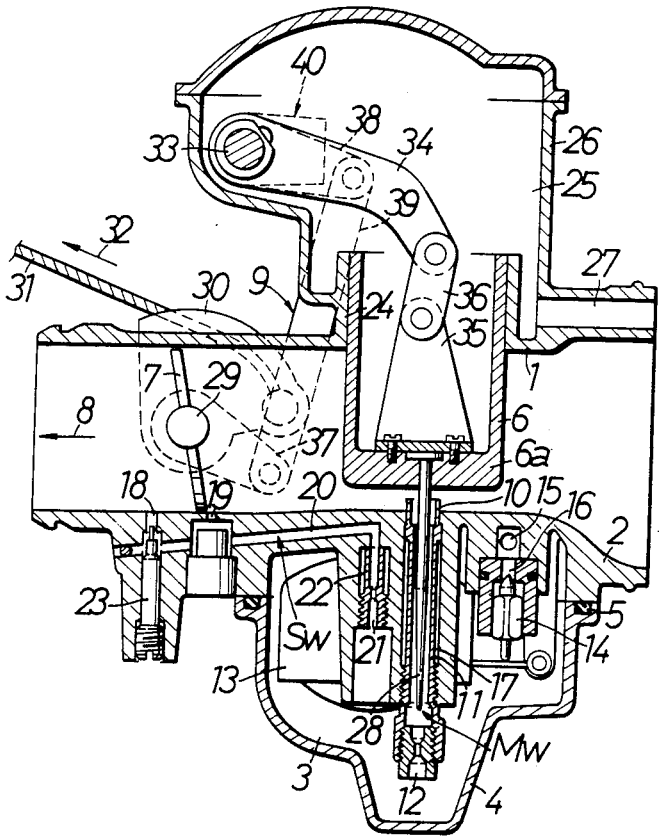
FIG. 1 is a vertical sectional view of the entire carburetor.

An embodiment of the present invention will be described with reference to the drawing. Referring first to FIG. 1, therein is seen an intake passage 1 provided in a carburetor body 2. A float chamber body 4 provided with a float chamber 3 is securely attached to the lower part of the carburetor body 2 through a sealing member 5. Disposed in the intake passage 1 are a slide valve 6 which is slidable across the intake passage 1, and a butterfly throttle valve 7 which is pivotally mounted on the carburetor body 2 downstream of the slide valve 6 in the direction of flow of air-fuel mixture indicated by arrow 8, the mixture being supplied to the cylinders of the engine (not shown) under suction. The slide valve 6 and the butterfly throttle valve 7 are interlocked from the fully closed positions to the fully open positions thereof by the action of an interlocking mechanism 9.

The carburetor body 2 is provided with a main fuel nozzle 10 which opens at the wall surface of the intake passage 1. An air bleed pipe 11 is unitarily and concentrically joined to the lower part of the main fuel nozzle 10. A main fuel jet 12 is mounted on the lower part of the air bleed pipe 11 and communicates with that portion of the fuel in the float chamber 3 below the fuel level. Thus, a main fuel passageway $M_w$ is formed which extends from the main fuel jet 12 via the air bleed pipe 11 to the main fuel nozzle 10 and which is open to the intake passage 1 directly below the slide valve 6. An annular chamber 17 defined around the air bleed pipe 11 is in communication with the upstream end of the intake passage 1 via an air bleed passage (not shown).

The carburetor body 2 is also provided with a subsidiary or low-speed fuel passageway $S_w$ which is open to the intake passage 1 near the butterfly throttle valve 7. More specifically, there are provided a pilot outlet 18 which is open to the intake passage 1 slightly downstream of the butterfly throttle valve 7, and a bypass port 19 which is open to the intake passage 1 slightly upstream of the fully closed position of the butterfly throttle valve 7. The outlet 18 and the port 19 communicate with a fuel passage 20 in common. A low-speed fuel jet 21 communicates with the fuel in the float chamber 3 below the fuel level and is connected to the fuel passage 20 through an air bleed pipe 22. In order to regulate the degree of opening of the pilot outlet 18, a pilot screw 23 is threadably engaged with the carburetor body 2.

A float 13 is disposed in the float chamber 3. A float valve 14 for opening and closing a valve port 16, which communicates with a fuel feed passage 15 provided in the carburetor body 2, abuts on a pivotal portion of the float 13 to effect the opening or closing operation in accordance with the vertical movement of the float 13.

The upper part of the carburetor body 2 is integrally provided with a guide barrel 24 which extends upwards in alignment with the main fuel nozzle 10. A housing 26 forming an air chamber 25 is integrally joined to the upper part of the guide barrel 24. The air chamber 25 is in communication with the upstream end of the intake passage 1 through a passage 27.

The slide valve 6 is in the shape of a cylinder which is closed at its bottom by wall **6*a* and is open at its top, and the valve 6 is in slidable engagement within the guide barrel 24. A needle valve 28 is secured to the bottom 6*a* of the slide valve 6 and extends into the main fuel nozzle 10**.

A throttle lever 30 is unitarily secured to the valve shaft 29 of the butterfly throttle valve 7, and a throttle wire 31, as a control member, is connected to the throttle lever 30. When the throttle wire 31 is drawn in the direction of arrow 32, the butterfly throttle valve 7 executes an opening operation. Moreover, the butterfly throttle valve 7 is biassed to be urged in the closing direction by a spring (not shown) so that valve 7 executes a closing operation upon relieving the force of traction with the throttle wire 31.

A rotary shaft 33 extends parallel to the valve shaft 29 and is rotatably supported by the housing 26. One end of a driving arm 34 is secured to the rotary shaft 33 in the air chamber 25. A bracket 35 is fastened to the slide valve 6, and the bracket 35 is connected to the other end of the driving arm 34 by a connecting rod 36. Accordingly, reciprocal rotating operation of the rotary shaft 33 is converted into reciprocal rectilinear motion of the slide valve 6 along the guide barrel 24, namely, the opening and closing operations thereof, through the driving arm 34, connecting rod 36 and bracket 35.

Figure 2:
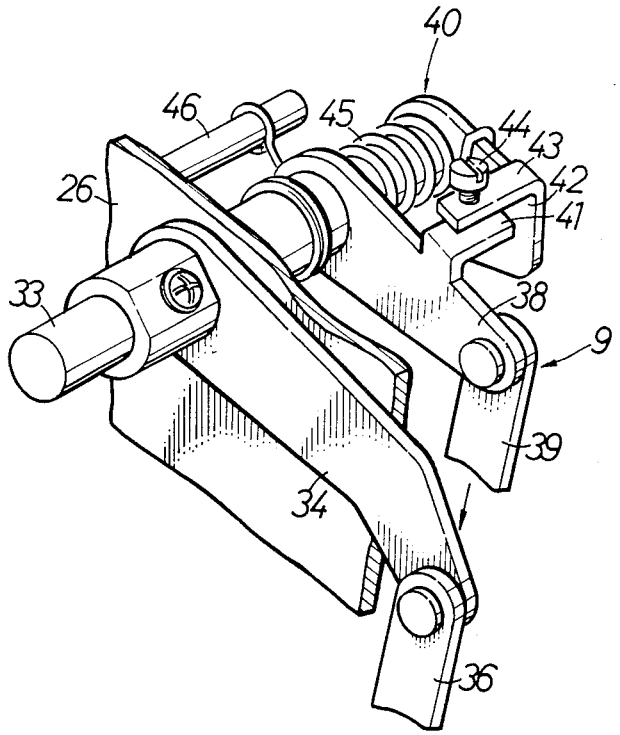
FIG. 2 is an enlarged perspective view of essential portions in FIG. 1.

Referring both to FIGS. 1 and 2, in order to interlock the opening and closing operations of the slide valve 6 with those of the butterfly throttle valve 7, the valve shaft 29 of the butterfly throttle valve 7 and the rotary shaft 33 are connected with each other by the interlocking mechanism 9. The interlocking mechanism 9 includes a first rocking arm 37 which is secured to the valve shaft 29 outside the carburetor body 2, a second rocking arm 38 which is mounted on the rotary shaft 33 outside the carburetor body 2, and a connecting arm 39 which connects both the rocking arms 37 and 38. An adjusting mechanism 40 is interposed between the second rocking arm 38 and the rotary shaft 33. As seen in FIG. 1, the arm 34 is longer than the arm 37. As a consequence of the lever ratio, reciprocating movement of the slide valve 6 is magnified compared to rotational movement of butterfly valve 7 whereby valve 6 travels more rapidly than valve 7.

A base part of the second rocking arm 38 is pivotally supported on the rotary shaft 33, and a lateral projection 41 protruding towards the adjusting mechanism 40 is provided at an intermediate part of the second rocking arm 38. The adjusting mechanism 40 includes a lever 42 which is fastened to an end portion of the rotary shaft 33 and which extends in the same direction as that of the second rocking arm 38. A supporting protuberance 43 projects laterally towards the second rocking arm 38 at the distal end of the lever 42 and overlies the projection 41. An adjusting screw 44 is in threadable engagement in the supporting protuberance 43 and can abut against the projection 41. A coil spring 45 urges the lever 42 in clockwise direction in FIG. 2 to cause the adjusting screw 44 to abut against the projection 41. The coil spring 45 encircles the rotary shaft 33, and one end thereof is held in engagement with a retaining pin 46 unitarily affixed to the housing 26, while the other end thereof is held in engagement with the lever 42.

With the interlocking mechanism 9 and the adjusting mechanism 40 described above, the opening operation of the butterfly throttle valve 7, i.e., the turning operation thereof in the counterclockwise direction as viewed in FIG. 1, which is effected by the throttle lever 30, is transmitted to the second rocking arm 38 through the first rocking arm 37 and the connecting arm 39, to cause the second rocking arm 38 to be turned in counterclockwise direction. Since, at this time, the adjusting screw 44 of the adjusting mechanism 40 is in resilient abutment against the projection 41 of the second rocking arm 38, the lever 42 and the rotary shaft 33 turn counterclockwise. The turning operation of the rotary shaft 33 is transmitted to the slide valve 6 through the driving arm 34, connecting rod 36 and bracket 35, so that the slide valve 6 is displaced upwards along the guide barrel 24, and thereby effects the opening operation.

Conversely, when the butterfly throttle valve 7 is turned for the closing operation in the clockwise direction in FIG. 1 by the throttle lever 30, the second rocking arm 38 is similarly turned clockwise. Following the clockwise turning operation of the second rocking arm 38, the lever 42 and the rotary shaft 33 turn clockwise so that the adjusting screw 44 may abut against the projection 41 under the action of the spring force of the coil spring 45. Accordingly, the slide valve 6 is depressed through the driving arm 34, connecting rod 36 and bracket 35 so as to execute the closing operation. On this occasion, the second rocking arm 38 is allowed to turn clockwise by the adjusting mechanism 40, so that the butterfly throttle valve 7 can close irrespective of the operation of the slide valve 6.

Moreover, the degree of opening of the slide valve 6 is predetermined, at least for low opening values, so as to be higher than that of the butterfly throttle valve 7 by a predetermined magnitude at all times. The slide valve 6 is also set so that, when the butterfly throttle valve 7 is in the fully open position, the end surface of the bottom wall **6*a* of the valve 6 is in a retracted position in the air chamber 25. Thus, even if the intake passage 1 and the slide valve 6 should have some fabrication errors, the slide valve 6 can be prevented from protruding into the intake passage 1** in the fully open state.

In the adjusting mechanism 40, the degree of opening of the slide valve 6 can be finely adjusted relative to that of the butterfly throttle valve 7 by advancing or retracting the adjusting screw 44. Moreover, since the adjusting screw 44 is held in resilient abutment with the projection 41 by the spring force of the coil spring 45, any mounting play of the first and second rocking arms 37,38 and the connecting arm 39 can be taken-up for smooth operations.

In operation, when the butterfly throttle valve 7 is driven to open or close through the operation of pulling the throttle wire 31, the slide valve 6 is responsively driven to open or close through the interlocking mechanism 9. In this case, since the butterfly throttle valve 7 is disposed downstream of the slide valve 6, a negative suction pressure does not have great effect as a force drawing the slide valve 6 toward the downstream side, and the frictional resistance between the slide valve 6 and the inner surface of the guide barrel 24 is comparatively low. Accordingly, the throttle wire 31 can be operated with a comparatively small traction force. Moreover, even when the degree of opening of the butterfly throttle valve 7 is suddenly increased for rapid acceleration, the slide valve 6 is opened in response to the sudden change. Accordingly, no delay in the opening operation develops, and an excellent accelerating characteristic can be attained. In addition, since the low-speed fuel passageway $S_w$ is open near the butterfly throttle valve 7, the discharge of fuel of the low-speed system is controlled in accordance with the degree of opening of the butterfly throttle valve 7, and a control of high precision can be achieved.

When the butterfly throttle valve 7 is fully closed, the slide valve 6 is in open state by the predetermined degree of opening. In the low-load running region, therefore, the controls of the flow rate of mixture and the air-fuel ratio thereof by the butterfly throttle valve 7 can be properly performed without the interference of the slide valve 6. Further, in the high-load running region, the slide valve 6 demonstrates a variable venturi function and controls the negative pressure over the main fuel nozzle 10 in accordance with the load so as to adjust the quantity of fuel injection from this main fuel nozzle. Thus, a mixture suited to the high load can be produced.

As another embodiment of the present invention, it is contemplated to secure the throttle lever 30 to the side of the rotary shaft 33 and to dispose the adjusting mechanism between the valve shaft 29 and the interlocking mechanism 9. In addition, the throttle lever 30 and the adjusting mechanism may be disposed on either side of the valve shaft 29 or the rotary shaft 33. However, the throttle lever 30 and the adjusting mechanism 40 should desirably be arranged in correspondence with the respective shafts 29 and 33 in order that components to be mounted on the respective shafts 29 and 33 may be dispersed to exhibit a compact construction in which the components project out of the carburetor body 2 in a balanced manner. Furthermore, the interlocking mechanism 9 need not be a linkage in which the first and second rocking arms 37,38 are connected by the connecting arm 39 as in the foregoing embodiment. It may well be one employing a cam by way of example, but the linkage has the advantage of being simple in construction and inexpensive in manufacture.

As set forth above, according to the present invention, the butterfly throttle valve is disposed downstream of the slide valve, and hence, the slide valve can avoid being attracted toward the downstream side by a negative suction pressure caused in the intake passage. Accordingly, frictional force acting on the slide valve is reduced to a comparatively small magnitude, and the slide valve can be operated by application of a relatively small force. In addition, the slide valve and the butterfly throttle valve are connected through the interlocking mechanism so as to perform their opening and closing operations in interlocking relation to each other over the range from the fully closed positions to the fully open positions and an external force to operate the slide valve and the butterfly throttle valve can be applied to either of these valves by the control member. Thus, the butterfly throttle valve and the slide valve are operated without incurring any time lag therebetween, so that excellent accelerating characteristics can be attained. Furthermore, in at least the condition of low opening degree of the slide valve and the butterfly throttle valve, the degree of opening of the slide valve is set to be higher than that of the butterfly throttle valve. Additionally, the main fuel passageway opens into the intake passage directly below the slide valve, and a low fuel passageway opens into the intake passage near the butterfly throttle valve. Therefore, in the low-load running region, the controls of the flow rate and air-fuel ratio of the mixture by the butterfly throttle valve can be performed properly without interference by the slide valve, while in the high-load running region, the quantity of fuel injected from the main fuel nozzle is controlled by the slide valve, and mixture suited to the high load can be produced.

Although the invention has been described in relation to preferred embodiments thereof, it will become apparent to those skilled in the art that numerous modifications and variations can be made within the scope and spirit of the invention as defined in the attached claims.

What is claimed is:

1. A variable venturi type carburetor comprising a carburetor body having an intake passage, a slide valve slidably supported in said body for travel across said intake passage to function as a variable venturi, a butterfly throttle valve pivotably supported by said body in said intake passage downstream of said slide valve, a low-speed fuel passageway and a main fuel passageway which opens into said intake passage proximate said butterfly throttle valve and directly below said slide valve, respectively, interlocking means operatively connecting said slide valve and said butterfly throttle valve for interlocked operation over a range from their fully closed positions to their fully open positions with a degree of opening of the slide valve higher than that of the butterfly valve by a predetermined magnitude at least for low opening degrees thereof, said interlocking means being constructed for controlling interlocked opening and closing operations of the slide valve and the butterfly throttle valve such that the slide valve is in open state by a predetermined degree of opening when the butterfly throttle valve is fully closed and the slide valve is completely retracted from the intake passage with no part thereof projecting into the passage in its fully open position, and control means for applying an external force to one of said valves for operating said slide valve and said butterfly throttle valve.

2. A variable venturi type carburetor as claimed in claim 1 wherein said interlocking means includes spring means interposed between the valves for the resilient transmission of force from said one valve to the other and for urging said other valve towards the closed position thereof.

3. A variable venturi type carburetor as claimed in claim 2 wherein said interlocking means further includes adjusting means between the slide valve and butterfly valve for adjusting the relative positions of the valves when closed.

4. A variable venturi type carburetor as claimed in claim 1 comprising a first shaft rotatably supporting a first of said valves on said first shaft, and means connecting said valves to open the valves conjointly.

5. A variable venturi type carburetor as claimed in claim 4 wherein said means which opens the valves conjointly comprises a resilient connection between said first valve and said shaft.

6. A variable venturi type carburetor as claimed in claim 5 comprising a second shaft on which the second of said valves is secured, said interlocking means comprising a linkage connecting said first and second shafts.

7. A variable venturi type carburetor as claimed in claim 6 wherein said interlocking means further comprises an adjusting means interconnecting said first shaft and said first valve for adjustably interconnecting the valves.

8. A variable venturi type carburetor as claimed in claim 6 wherein said first valve in said slide valve and said second valve is said butterfly valve, said linkage including a first arm coupled to said second shaft to transmit rotation motion from said second shaft to said first shaft and a second arm connected to said first shaft to transmit rotation motion from said second shaft to said slide valve as sliding motion thereof, said second arm having a greater length than said first arm whereby to magnify the magnitude of movement of said slide valve relative to the movement of said butterfly valve.

9. A variable venturi type carburetor as claimed in claim 1 wherein said interlocking means includes spring means between the slide valve and butterfly valve for resilient transmission of force between said one valve and the other of said valves, and abutment means for transmitting force in one direction from said one valve to the other valve to open said valves, said spring means acting on said other valve to close the same when said one valve is closed.

10. A variable venturi type carburetor as claimed in claim 9 wherein said abutment means is adjustable to adjust the relative positions of the valves when closed.

11. A variable venturi type carburetor as claimed in claim 10 wherein said abutment means and spring means are interrelated so that opening of said other valve is effected through said spring means and abutment means.

12. A variable venturi type carburetor as claimed in claim 11 wherein said abutment means includes a pair of opposed members respectively coupled to said valves and an adjustment member adjustably secured in one of said opposed members and in abutment with the other of said opposed members under the action of said spring means.

13. A variable venturi type carburetor as claimed in claim 12 wherein said opposed members act through said adjustment member to cause said other valve to be opened directly and without lag in response to opening of said one valve.

14. A variable venturi type carburetor as claimed in claim 11 comprising a rotatable shaft, connection means secured to said shaft and to a first of said valves for transmitting movement from said shaft to said first valve, the second of said valves being rotatable with respect to said shaft.

15. A variable venturi type carburetor as claimed in claim 14 comprising a second shaft on which said second of said valves is secured and wherein said control means is coupled to one of said shafts and said adjustable abutment means is coupled to the other of said shafts.

16. A variable venturi type carburetor as claimed in claim 15 wherein said control means and adjustable abutment means are located externally of said body.

* * * * *